US005167529A

United States Patent [19]

Verge

[11] Patent Number: 5,167,529

[45] Date of Patent: Dec. 1, 1992

[54] BOOSTER CABLE ASSEMBLY

[76] Inventor: Cyril A. Verge, 2 Hazel Street, Lr., Sackville, Nova Scotia, Canada, B4E 1E4

[21] Appl. No.: 749,951

[22] Filed: Aug. 26, 1991

[30] Foreign Application Priority Data

Apr. 7, 1991 [CA] Canada ..... 2046184

[51] Int. Cl.[5] ..... H01R 11/00

[52] U.S. Cl. ..... 439/504; 439/491; 439/759; 439/500; 429/1; 429/179

[58] Field of Search ..... 439/502-504, 439/506, 491, 500, 759, 677-679; 429/1, 179

[56] References Cited

U.S. PATENT DOCUMENTS 4,693,948 9/1987 McEwan ..... 429/1

4,869,688 9/1989 Merio ..... 439/504

*Primary Examiner*—Paula A. Bradley

*Attorney, Agent, or Firm*—McFadden, Fincham, Marcus & Anissimoff

[57] ABSTRACT

There are disclosed booster cable assemblies in which the clamps or terminal receiving members thereof include first cooperating clamping elements which may be releasably locked in cooperative engagement with battery terminals providing second cooperating elements which mate and releasably lock only with a clamping member of a similar polarity. The arrangement precludes improper connection of the clamping members with the incorrect terminal.

16 Claims, 11 Drawing Sheets

BOOSTER CABLE ASSEMBLY

FIELD OF THE INVENTION

The present invention relates to a booster cable assembly and more particularly, it relates to an assembly which provides cooperating and releasably lockable cable clamps and terminals to prevent improper polarity connection between a pair of batteries.

BACKGROUND OF THE INVENTION

Booster cable assemblies or "jumper" cables for transferring electrical energy from a host battery to a receiving battery are well known in the art. Such assemblies have taken many forms, one of which is illustrated in U.S. Pat. No. 4,913,668. This document describes a battery clamp which provides a plurality of gripping surfaces for simple connection to a variety of battery terminal types. The device addresses this problem but, over time, tends to damage the terminals of the battery from exposure of the gripping projections thereto.

Further, in U.S. Pat. No. 4,826,457, Varatta provides a booster cable clamp having jaws which are angularly inclined relative to the handle portions. The handles are electroconductive and thus, in the event of disconnection from a terminal during a boosting operation, can cause grounding, sparking or shorting and therefore such an arrangement is inappropriate. In addition, the clamping jaws provide teeth, however, these do not cooperate and lock with the battery for positive engagement.

U.S. Pat. No. 4,396,692 discloses an arrangement wherein there is provided a battery which threadably receives different terminal shapes. The patentee only provides the conventional cylindrical terminals having a smooth surface which do not facilitate locking engagement with the jaws of the booster handles.

Other general advancements in the art are disclosed in U.S. Pat. Nos. 4,448,863, 4,759,728 and 4,929,522.

Although the art provides various improved clamp assemblies, battery terminals etc., none of the references discloses a non-conductive system which prevents the positive terminals of a host battery from being connected to the negative terminals of a receiving battery.

SUMMARY OF THE INVENTION

Applicant, with the present invention, provides a novel booster assembly which, in the preferred embodiments, eliminates all of the electrical hazards concomitant with conventional assemblies, while additionally providing releasably lockable cooperative engagement between a battery terminal and a booster clamp. More particularly, in accordance with the present invention, Applicant provides a battery and jumper cable system for polarized connection between separate batteries comprising:

a pair of batteries each having a negative and positive terminal associated therewith;

each positive terminal of each battery having a first cooperative engaging member adapted to cooperatively engage a corresponding positive cooperative engaging member of a jumper cable;

each negative terminal of each battery having a second cooperative engaging member adapted to cooperatively engage a corresponding negative cooperative engaging member of a jumper cable;

a jumper cable having first and second jumper cable assemblies having opposed ends, each opposed end having a pair of conductive battery terminal clamping members each adapted to engage only a pre-selected negative or positive battery terminal;

one clamping member of each end having a first cooperating engaging means for engaging a positive battery terminal;

the other clamping member of each end having a second cooperating engaging means for engaging a negative battery terminal;

the first and second cooperating engaging means of each pair of clamping members at each end of the jumper cable being non-engageable with one another and non-engageable with a battery terminal of an opposite polarity with which the engaging member is adapted to engage.

The clamping members, in one form, are fabricated from a non-conductive material capable of withstanding temperature extremes, exposure to battery terminal corrosion products etc.; suitable materials to achieve this result include, for example, polypropylene, polyvinylchloride, nylon, ABS and other such materials. The clamping members may be molded using any of the techniques known in the art.

The terms clamp, clamping and other grammatical forms thereof as used herein are used to denote such objects which are capable of engaging and/or holding firmly.

The booster assembly, as with the known arrangements, includes a pair of elongated conductors each having ends with each end including a clamping member connected thereto.

The clamping members of the elongated conductors include, at the terminal contacting ends thereof, cooperating means for cooperative engagement with the terminals of the battery. The cooperating means may comprise a projection or recess adapted for releasable locking and cooperative engagement with a similarly configured battery terminal.

Each clamping member of a single elongated conductor will include a similarly configured cooperating means for polarity matching between the terminals of the host and receiving batteries, while the clamping members of the second conductor include similarly configured cooperating means different from that of the first and additionally non-engageable therewith.

The recesses or projections may comprise any configuration e.g. positive (+) and negative (−) symbols, circular and square configurations etc.

In the case of a positive symbol recessed within a clamping member, the battery terminal mount will be a projecting positive symbol to thus provide releasable cooperative engagement therewith.

Any configuration for the mountings and clamps will be adequate provided they do not cooperate within one another, thus defeating the purpose of polarity matched connection and allowing a user to improperly connect a positive clamping member on a negative terminal.

One object of one embodiment of the present invention is to provide a jumper cable for polarized connection between separate batteries comprising:

first and second jumper cable assemblies having opposed ends, each opposed end having a pair of conductive battery terminal clamping members each adapted to engage only a pre-selected negative or positive battery terminal;

one clamping member of each end having a first cooperating engaging means for engaging a positive battery terminal;

the other clamping member of each end having a second cooperating engaging means for engaging a negative battery terminal;

the first and second cooperating engaging means of each pair of clamping members at each end of the jumper cable being non-engageable with one another and non-engageable with a battery terminal of an opposite polarity with which the engaging member is adapted to engage.

The recesses or projections of the clamping members in the preferred embodiments communicate with an electrical conductor extending therein and connected to the elongated conductor. In this arrangement, no electroconductive material is exposed, thus eliminating the possibility of sparking, etc. inherent to the known arrangements.

The adapter members, for connection with the clamping members, may be individually manufactured or, in the alternative, may be manufactured in situ with conventional batteries.

In order to substantially eliminate any shorting hazard, it is preferred that the adapters, in the preferred embodiments, provide a conductive body comprising one of the conventional conductor metals, which is encased in a nonconductive housing of a material similar to that of the clamping members. Similar to the clamping members, the adapters may be molded.

Further, the adapters may be connected directly to the terminals of the batteries or indirectly thereto via the battery cables associated therewith.

The adapters may be used with existing clamping members having a cooperating element and thus, a further object of yet another embodiment of the present invention is to provide a set of mountings for mounting to two similarly polarized terminals of a pair of batteries, the mountings comprising:

first and second pairs of mounting members, the members of the first pair each being releasably engageable with a positive terminal of each of the batteries and including first cooperating means;

the members of the second pair each being releasably engageable with a negative terminal of each of the batteries and including a second cooperating means;

the first cooperating means adapted for mating and cooperative engagement with the terminal receiving means of a jumper cable having first complementary engaging means adapted to engage the first cooperating engaging means;

the second cooperating means adapted for mating and cooperative engagement with the terminal receiving means of a jumper cable having second complementary engaging means adapted to engage the second cooperating engaging means;

the first and second complementary engaging means of the terminal receiving means being non-cooperatively engageable with one another and non-cooperatively engageable with the second and first cooperating engaging means of the first and second pair of members, respectively.

Similarly, the clamping members of the present invention may be used on conjunction with existing cooperating adapter members and accordingly, conventional batteries and booster cable assemblies may be retrofit with adapters and inserts to provide the cooperating engagement therebetween according to the present invention.

In an alternate embodiment, the assembly may include a combination of recesses and projections for cooperative engagement with battery terminal adapters.

Having thus generally described the invention, reference will now be made to the accompanying drawings, illustrating preferred embodiments.

DETAILED DESCRIPTION OF THE PREFERRED EMBODIMENTS

Figure 1:
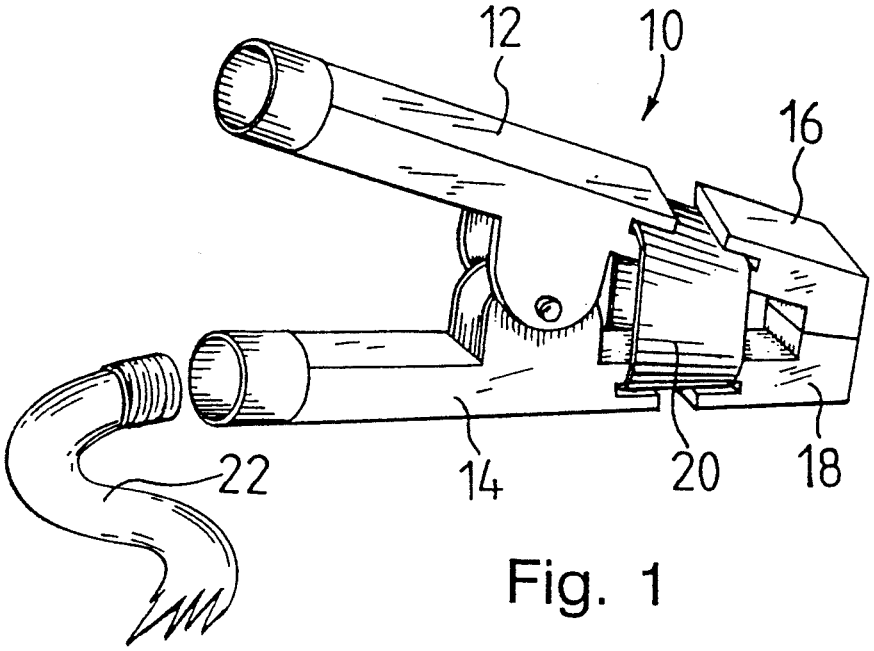
FIG. 1 is a perspective view of the clamping member of the booster assembly.

Referring now the drawings, FIG. 1 illustrates a perspective view of the booster clamp assembly generally indicated by numeral 10. A single handle assembly 10 is shown, however, it will be understood that the cable assembly includes a total of four such clamp assemblies.

In general overview, the assembly includes a pair of pivotally connected handles 12 and 14, preferably connected by a nonconductive pin comprising e.g. PVC, nylon etc; when metal pins are used for hinge purposes in the present invention, these will of course be encapsulated with a nonconductive material. Each of the handles 12 and 14 includes a battery terminal contacting portions 16 and 18 which are normally biased to a closed position, i.e. in facing relation by biasing means 20 e.g. an elastic band, nonconductive spring, etc. An elongated conductor 22 is preferably connected to at least one of the handles 12 or 14 by threaded connection therewith. The elongated conductor 22 may additionally extend therethrough for electrical communication with contacting portion 16 or 18.

In this arrangement, the handle assembly 10 is particularly safe for use since no conductive surfaces are exposed. This is further complemented by the use of an elastic band 20 as the biasing means.

Figure 3:
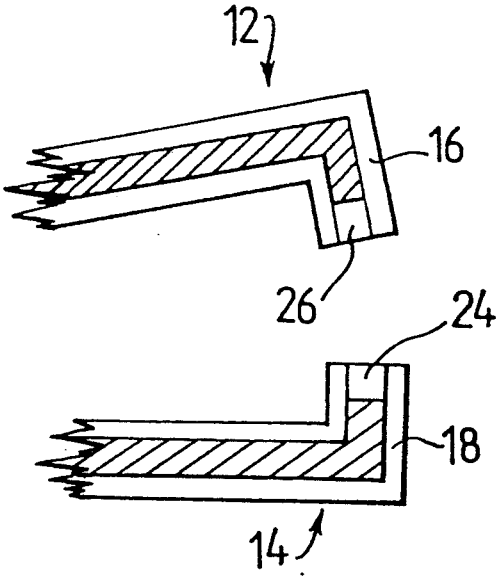
FIG. 3 is an enlarged exploded view of one form of the cooperating means of the clamping member of FIG. 2.

In greater detail and referring to FIG. 3, shown is a longitudinal sectional view of the assembly 10 with the biasing means 20 removed for clarity. In this example, the terminal contacting portions 16 and 18 each provide an inwardly extending open recess 24 and 26. The recess 24 receives a portion of the conductor 22 extending through arms 14 and recess 26 which, identical to recess 24, provides a first cooperating means adapted for engagement with mating cooperating means provided on battery terminal mountings (hereinafter described).

Figure 4A:
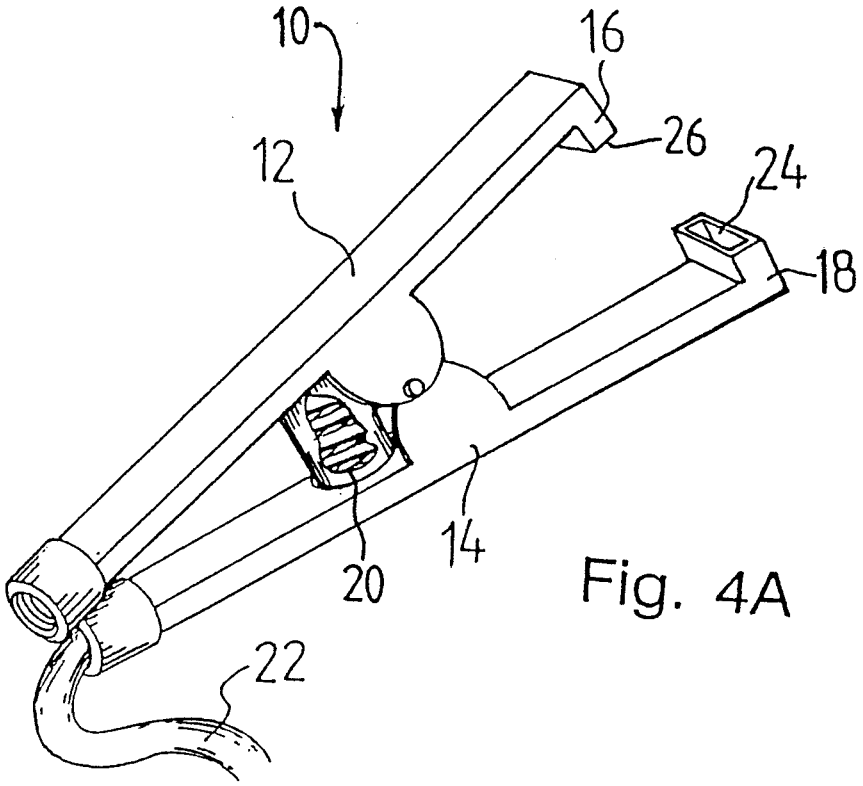
FIG. 4A is a perspective view of the clamping members of one conductor of the booster assembly.
Figure 4B:
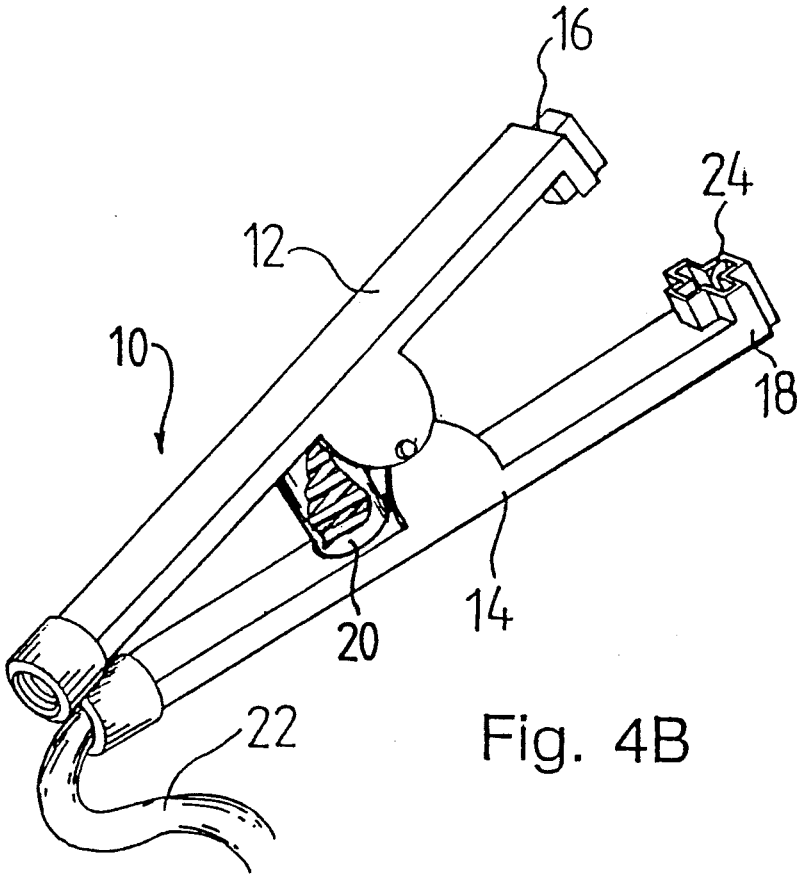
FIG. 4B is a perspective view of the clamping members of the second conductor of the booster assembly.

FIGS. 4A and 4B show the handle assembly in which the configuration of the identically shaped recesses 24 and 26 of one conductor are different from those of the handle assemblies of a second conductor. The booster cable assembly according to the present invention will have a similarly configured recess in the handle assemblies at each end of a single conductor which are non-engageable with the recesses of the handle assemblies of the other conductor. In this arrangement, proper polarized connection between e.g. a pair of positive or a pair of negative terminals is always ensured. In the embodiment, the biasing means 20 preferably comprises a spring extending between the handles 12, 14 and encased in a nonconductive jacket.

Figure 5A:
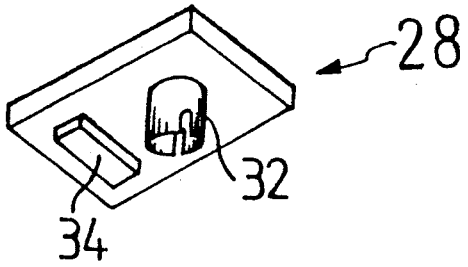
FIG. 5A is a perspective view of the battery terminal adapter for engagement with the clamping members of FIG. 4A.
Figure 5B:
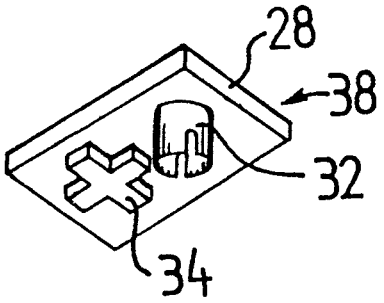
FIG. 5B is a perspective view of the battery terminal adapter for engagement with the clamping members of FIG. 4B.
Figure 6:
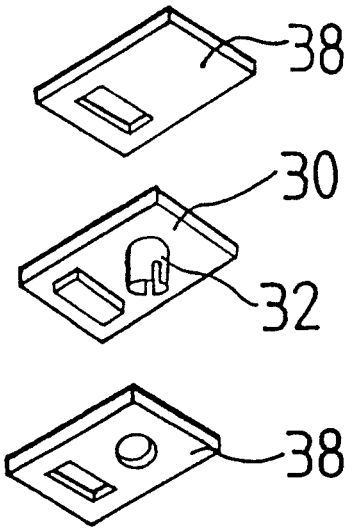
FIG. 6 is an exploded view of FIG. 5A.

Referring to FIGS. 5A, 5B and 6, shown are the battery terminal mountings in one embodiment according to the present invention. The mounting, generally represented by numeral 28, includes a conductive inner body 30 (FIG. 6) comprising a suitable conductive metal which includes a battery terminal connecting member 32 extending therefrom for connection with a battery terminal. The body 30 includes aligned projections 34,36 (36 not shown) on opposed sides thereof. A non-conductive housing 38 is provided to encapsulate the conductive body while leaving the projections 34,36 and connecting member 32 exposed. The housing 38 may be fabricated in two or more pieces or may be molded to body 30. Similar material as discussed for the handles 12,14 may be used to fabricate the housing 38.

In use, the recesses 24,26 of the handle assemblies shown in FIGS. 4A and 4B releasably lock in cooperative engagement with the projections 34,36 of the mountings of FIGS. 5A and 5B, respectively. The projections 34,36 are received within the recesses 24,26 for electrical contact therewith, while being releasably engaged.

In a second embodiment, the recesses and projections of the clamp assemblies and mountings respectively may be reversed so that the mountings include recesses and the clamp assembly projections.

Figure 7A:
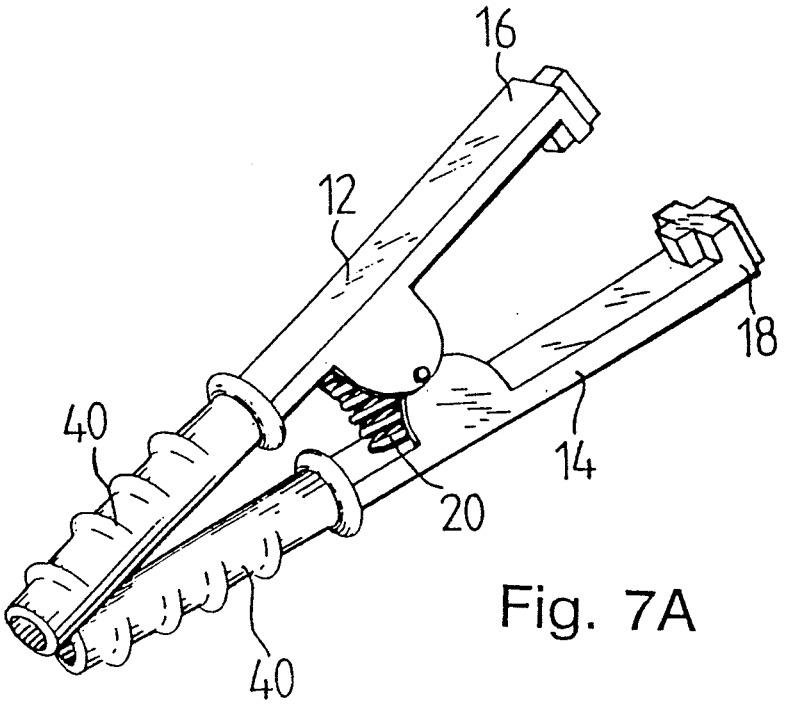
FIG. 7A is a perspective view of a further embodiment of the clamping member for engagement with a positive battery terminal adapter.
Figure 7B:
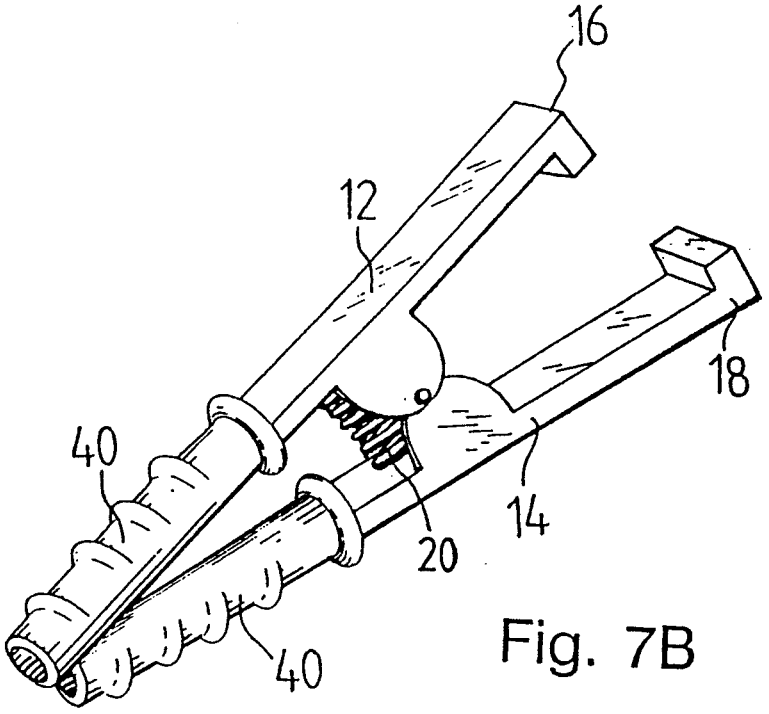
FIG. 7B is a perspective view of a further embodiment of the clamping member for engagement with a negative battery terminal adapter.

Turning now to FIGS. 7A and 7B, shown are clamping assemblies 10 according to another embodiment of the present invention. Similar numerals refer to similar components from previously described embodiments. The clamping assemblies 10 illustrated in the drawings comprise conductive handles 12,14 which include conductive terminal contacting portions 16,18. In this embodiment, the portions 16 and 18 are integral with the handles 12 and 14 and project therefrom. Insulating sleeves 40, comprising a non-conductive material as described herein previously, are provided on each handle 12 and 14.

Figure 2:
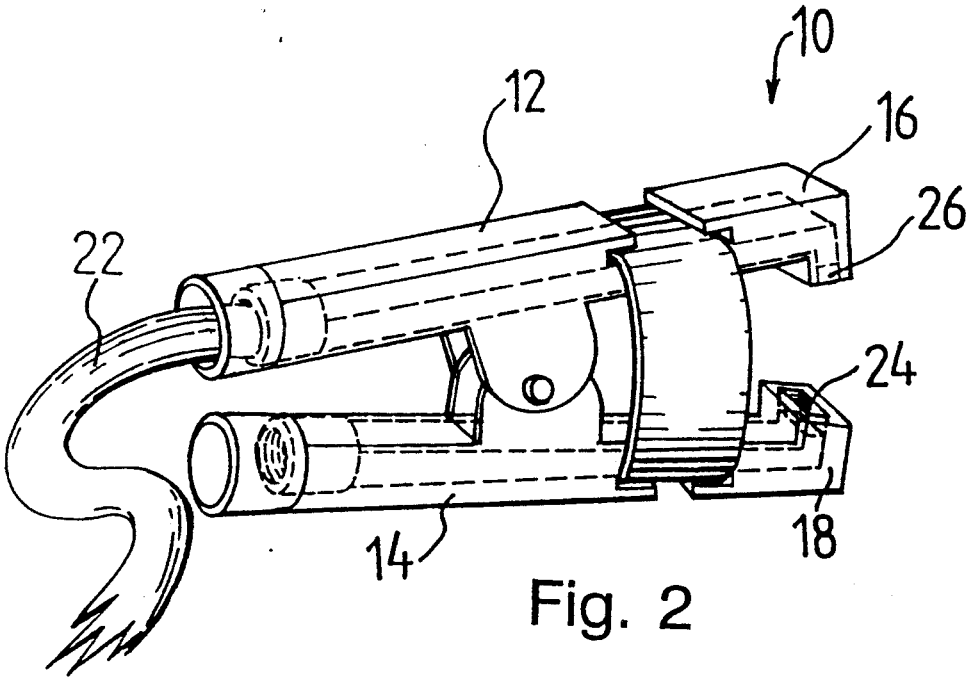
FIG. 2 is a perspective view partially cut away of an alternate embodiment of FIG. 1.
Figure 8A:
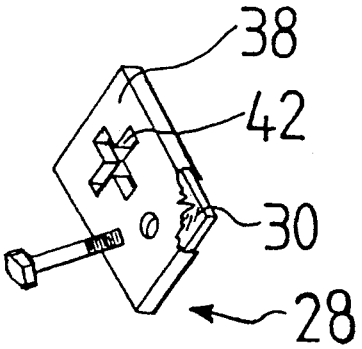
FIG. 8A is a perspective view of a further embodiment of the adapter for mounting to a positive battery terminal.
Figure 8B:
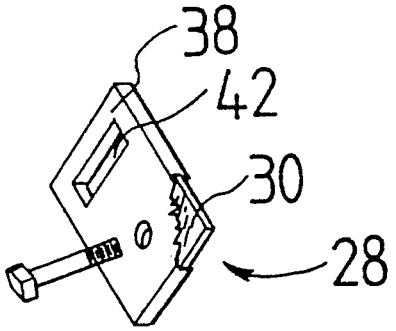
FIG. 8B is a perspective view of a further embodiment of the adapter for mounting to a negative battery terminal.

FIGS. 8A and 8B illustrate mountings for mounting to the battery terminals for locking and cooperative engagement with the handle assemblies 10 of FIGS. 7A and 7B, respectively, or with the handle assemblies 10 illustrated in FIGS. 1 and 2 when the same incorporate projections for the cooperating means.

The mountings 28, in the embodiment illustrated in FIGS. 8A, 8B, include aligned apertures 42 within the housing 38 providing access to the conductive body 30. Thus conductive body 30 is recessed with respect to the housing 28 as illustrated in the Figures. As such, the apertures 42 are configured to cooperatively receive the portions 16 and 18 of a corresponding handle assembly 10. The mounting 28 may be mounted to the battery terminals with suitable fastening means e.g. screws, clamps, bolts, etc.

Figure 9:
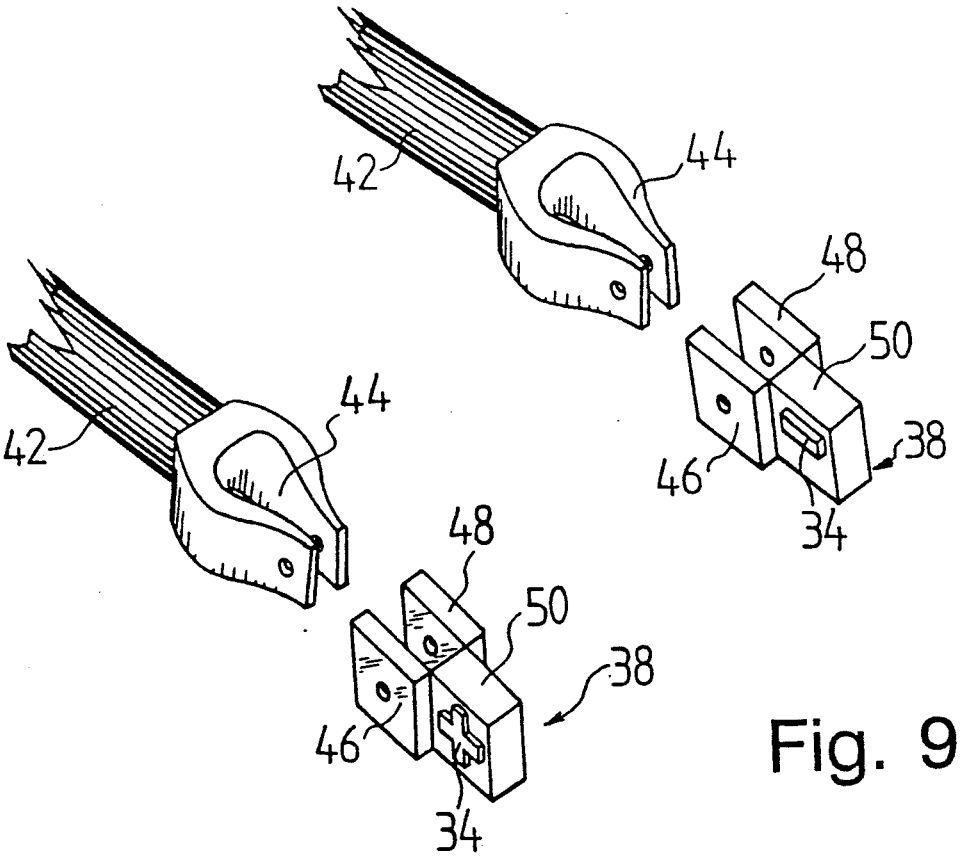
FIG. 9 is a perspective view of another embodiment of the adapters.

FIG. 9 illustrates a further embodiment of the mountings 28 adapted for use with battery conductors 42 each having a terminal clamp mount 44 thereon.

The mountings each include conductive spaced apart plate members 46,48 which are connected to the terminal clamps 42. The plate members 46 and 48 terminate in a body 50 rendered non-conductive by housing 38. The conductive projection 34 of each adapter 28 facilitate electrical communication with a cooperating clamping assembly 10 when connected therewith.

Figure 10:
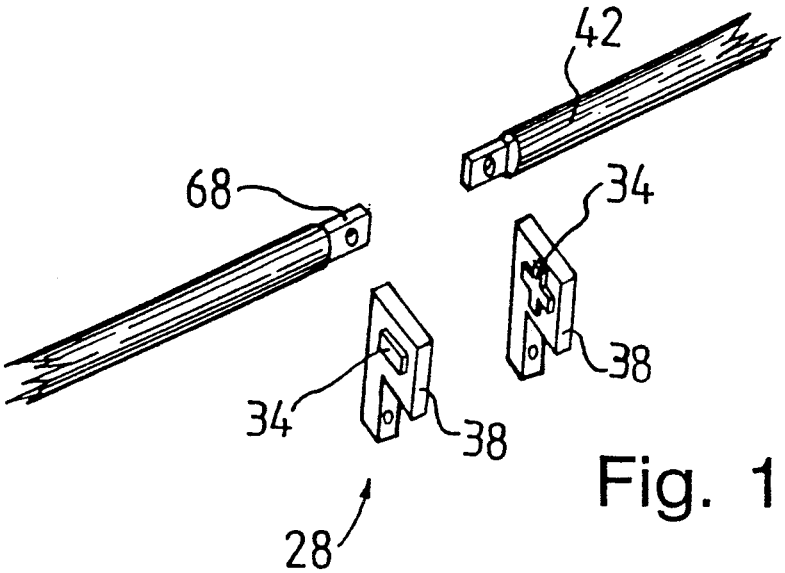
FIG. 10 is a perspective view of yet another embodiment of the adapters.

FIG. 10 illustrates yet another embodiment of the mountings 28. The mountings 28 illustrated are particularly useful for side mounted terminals. As with the previously described mountings, a non-conductive housing 38 surrounds the conductive projections 34.

Figure 11:
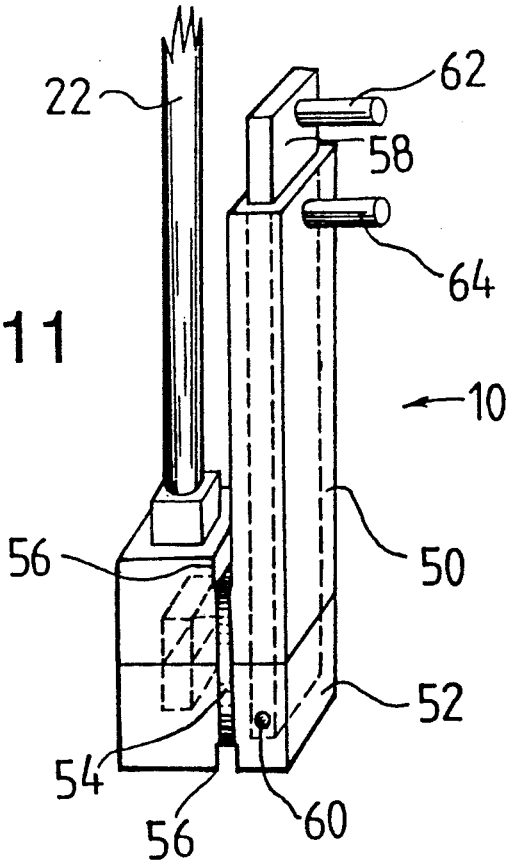
FIG. 11 is a perspective view of a further embodiment of a clamping member of the present invention.

FIG. 11 illustrates a further embodiment of the handle assembly 10 of the present invention. Similar numerals from previous embodiments indicate similar components.

The embodiment illustrated provides a non-conductive L-shaped handle member 50 which receives the conductor 22 at the base thereof. The handle member 50 includes a releasably engageable battery terminal engaging member 52 which is biased in facing relation for contact with the base portion of handle member 50 by suitable means e.g. an elastic band 54. Slots 56 are provided on the handle 50 and engaging members 52 to receive the elastic band 54.

The arm of the handle member 50 slidably mounts therein a slat member 58 which extends the length thereof and connects to the terminal engaging member 52 via a pin 60. Gripping members 62,64 are provided on the slat 58 and handle member 50, respectively, to enable a user to slide the slat 58 in handle member 50 thus displacing the terminal engaging member 52 from facing contact with the base of handle 50. Having done this, the handle assembly 10 may be engaged with a battery terminal adapter member or mounting 28 as illustrated in FIG. 12.

Figure 12:
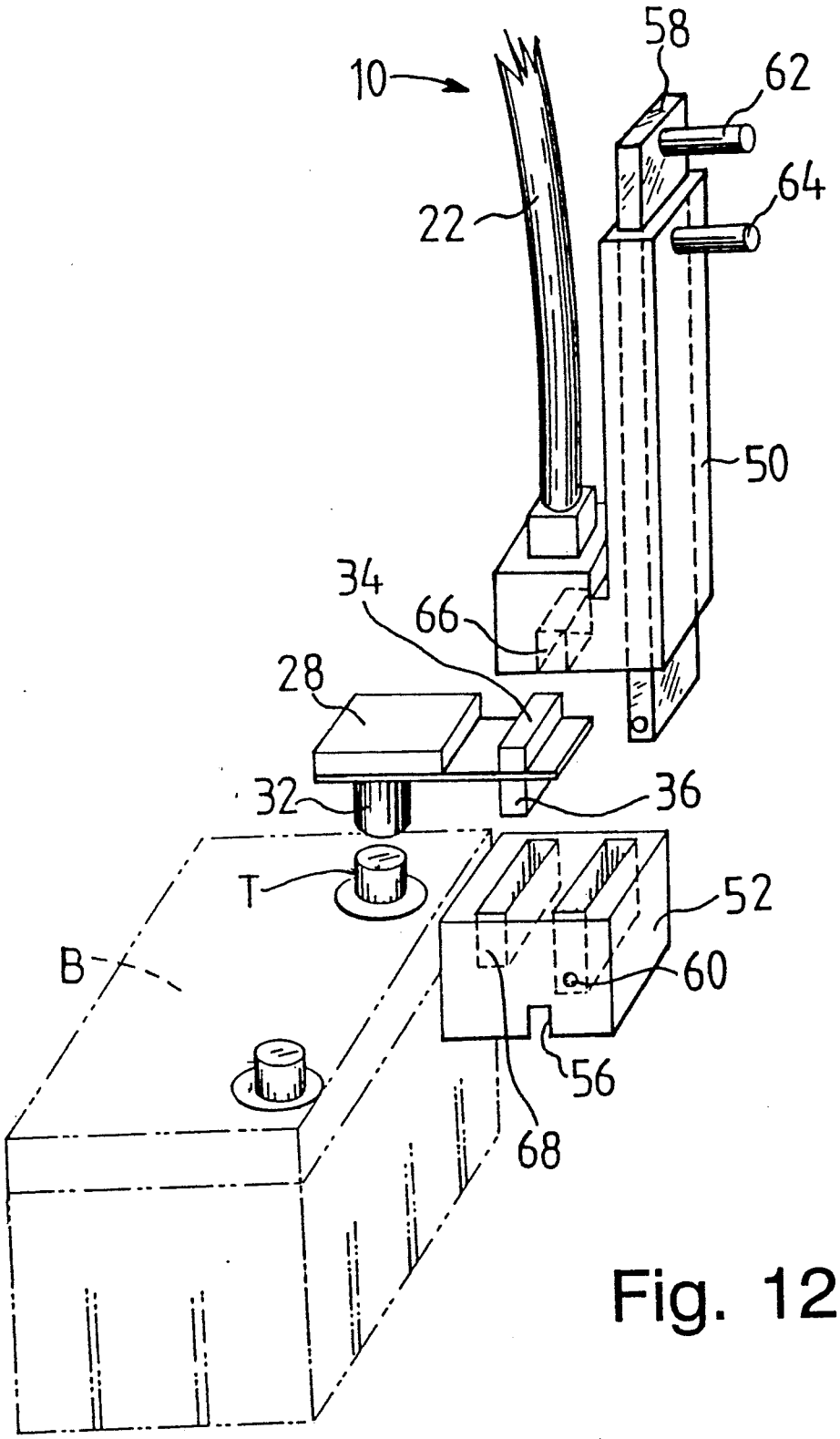
FIG. 12 is an exploded view of the clamping member as positioned about a battery terminal.

FIG. 12 illustrates an exploded view of the handle assembly 10 and terminal adapter or mounting 28 as would be positioned on a terminal T of battery B. The base of the handle member 50 provides an axial recess 66 which is in electrical communication with conductor 22. Similarly, the terminal engaging member 52 provides recess 68 in alignment with recess 66. The recesses 66,68 receive the conductive projections 34 and 36 of the battery terminal adapter or mounting 28 for releasable cooperative engagement therewith. Once engaged, the elastic 54 (omitted for clarity) urges members 50 and 52 into a releasably locked relationship with the projections 34 36 of adapter or mounting 28. Since the handle assembly 10 comprises non-conductive material, electrical sparking, shorting etc. is precluded.

Although one handle assembly 10 has been illustrated in the example, it will be readily appreciated that two such handles are incorporated for the host and receiving batteries. In addition, the arrangement in the example may be modified such that the handle member 50 and engaging member 52 include projections for engagement with an adapter as illustrated in FIGS. 8A and 8B.

Figure 13A:
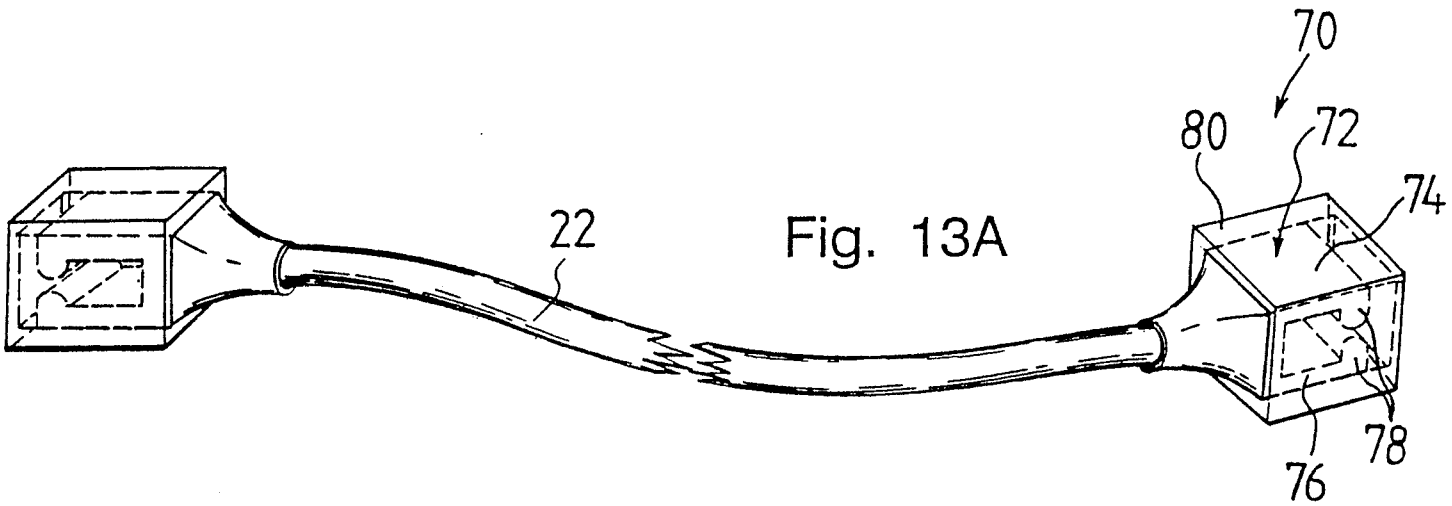
FIG. 13A is a perspective view of an alternate embodiment of the jumper cable assembly according to the present invention.
Figure 13B:
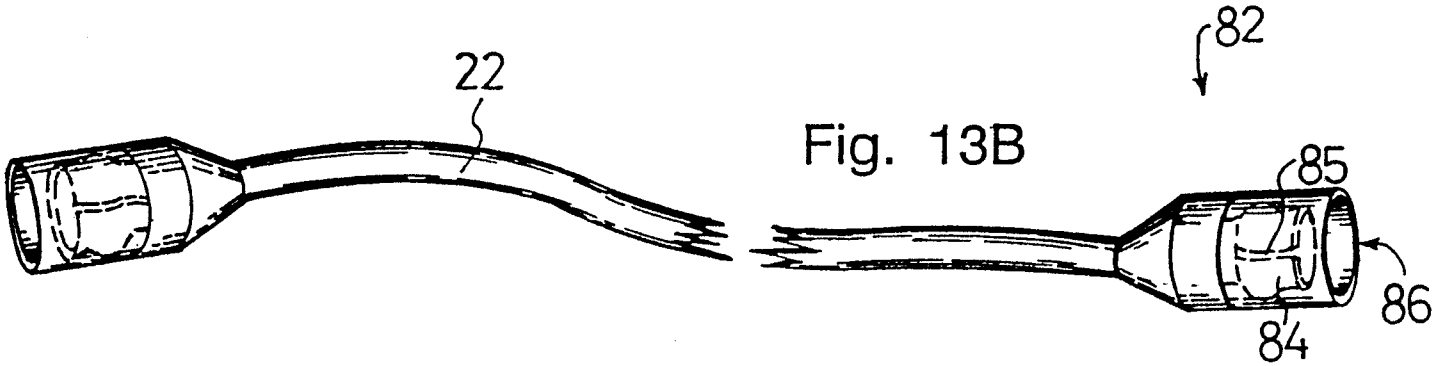
FIG. 13B is a perspective view of an alternate embodiment of the jumper cable assembly according to the present invention.

Referring now to FIGS. 13A and 13B, shown are perspective views of a further embodiment of the jumper cable assembly according to the present invention in which similar numerals denote similar components from previous embodiments. In this embodiment, the clamping members have been replaced with conductive socket members 70 and 82 in FIGS. 13A and 13B, respectively. Considering FIG. 13A, a socket member 70 is associated with each end of the conductor 22 and includes a conductive terminal contacting member 72 comprising an inwardly biased resilient C-shaped member in electrical communication with the conductor 22. Spaced apart arms 74 and 76 of member 72 include, at the forward ends thereof, projections 78. The projections 78 are adapted to cooperatively engage and releasably lock with opposed detents provided on the mounting illustrated in FIG. 14A and described hereinafter. The C-shaped member 72 is preferably inwardly biased to facilitate tight and positive engagement with the mounting and further includes an insulating hood member 80 composed of e.g. PVC, rubber, etc. surrounding the same. The combination of these features substantially reduces injury from sparking in the event of inadvertent disconnection of the sockets 70 during a charging operation.

FIG. 13B illustrates the second conductor of the cable assembly in which each end of conductor 22 is provided with socket 82 which includes a hollow cylindrical waisted terminal mount receiving member 84 comprising a conductive metal and including a split 85 therein. This arrangement facilitates resilient expansion and contraction of the member 84 to ensure positive releasable lockable engagement with the battery terminal mounting illustrated in FIG. 14B. An open-ended insulating sleeve 86 surrounds member 84 for safety purposes.

Figure 14A:
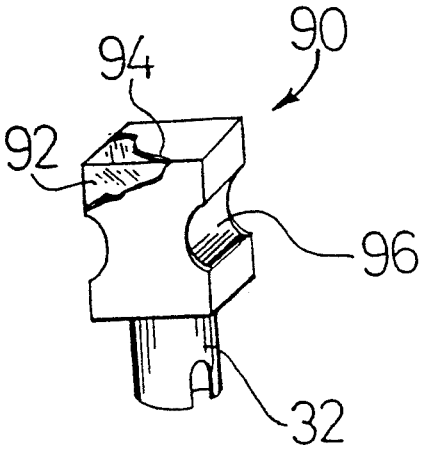
FIG. 14A is a perspective view of a battery terminal adapter for use with the jumper cable of FIG. 13A.
Figure 14B:
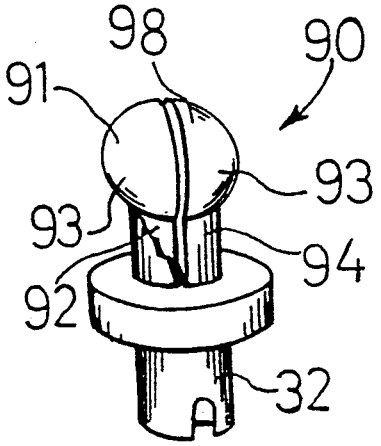
FIG. 14B is a perspective view of a battery terminal adapter for use with a jumper cable of FIG. 13B.
Figure 16:
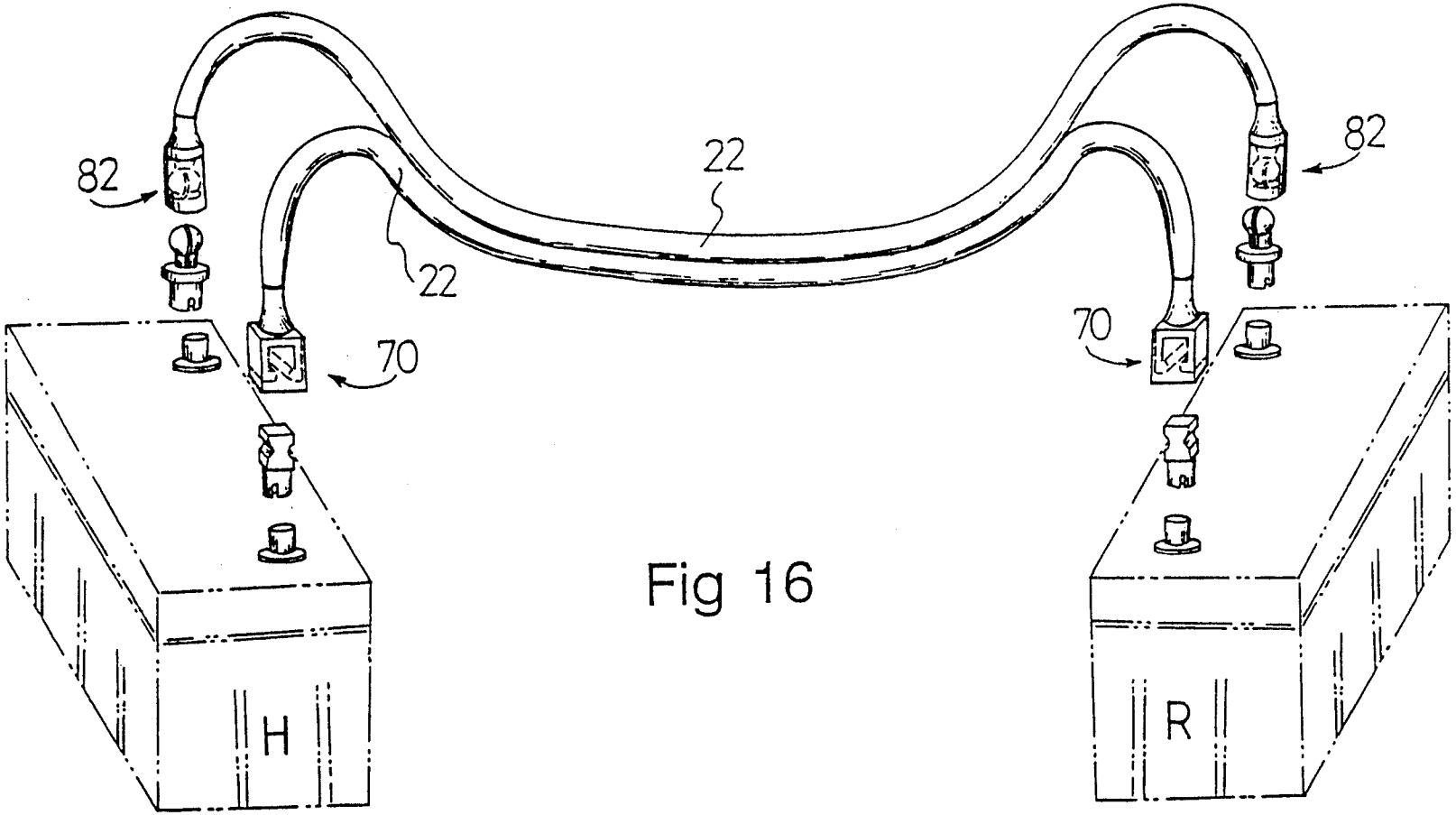
FIG. 16 illustrates a perspective view of jumper cables of FIGS. 13A and 13B in use between a pair of batteries.

In operation, socket 82 is releasably lockable with the cooperating battery mounting illustrated in FIG. 14B. In use, member 84 is slidably forced over the resilient fingers of mounting causing the member 84 to open slightly for contact with the mounting illustrated in FIG. 14B; this is generally illustrated in FIG. 16 showing the host battery, H and receiving battery, R. In view of the open socket arrangement of this embodiment, the user must exercise some degree of care during use compared to that required for previously set forth embodiments.

Turning now to FIGS. 14A and 14B, shown are perspective views of a further embodiments of the battery terminal mountings of the present invention. The mountings generally represented by numeral 90 each include a conductive inner body 92 comprising a suitable conductive metal with a battery terminal connecting member 32 extending therefrom as described herein previously. Each of the mountings, in one form, can include a nonconductive housing 94 or coating encapsulating the same. The mounting illustrated in FIG. 14A includes opposed hemispherical detents 96 adapted to receive the projections 78 of the cable assembly illustrated in FIG. 13A. The detents 96 preferably include smooth edges to facilitate disconnection of the projections 78 therefrom when a user desires to do so.

The projections 78 of both of mounting 90 are, of course, not encapsulated so that electrical communication between the mountings and cable assemblies remains unimpeded.

The mounting 90 illustrated in FIG. 14B includes a pair of spaced apart resilient upwardly projecting fingers 91 each having an outwardly extending hemispherically shaped lateral segment 93. In this form, the mountings 90 are releasably lockable with sockets 82 as illustrated in FIG. 13B.

As is readily apparent, the cable assemblies and mountings are not interengageable or mutually engageable, thus precluding improper polarity connection of the same.

Suitable insulating materials as discussed herein previously may be used to fabricate the housing or coatings for the mountings 90.

Figure 15:
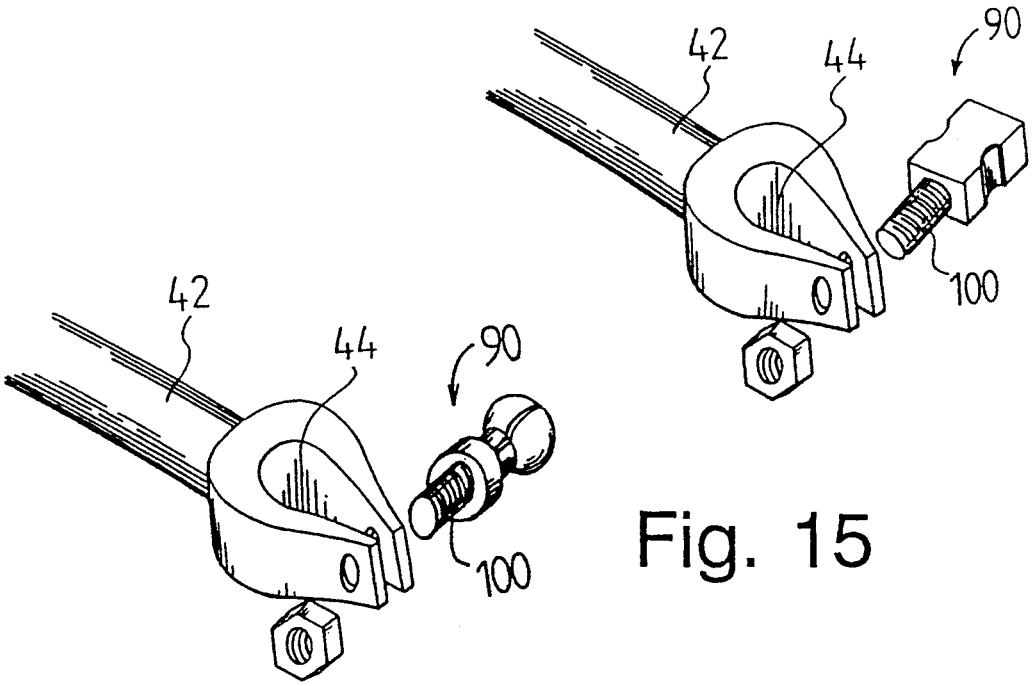
FIG. 15 is a perspective view of an alternate embodiment of the mountings illustrated in FIGS. 14A and 14B.

FIG. 15 illustrates a further embodiment of the mountings 90 for use with battery conductors 42 having terminal clamp mounts 44. The mountings 90 include threaded segments 100 for fastening with the mounts 44.

The mountings 90 may be readily modified for batteries employing side terminals.

Figure 17:
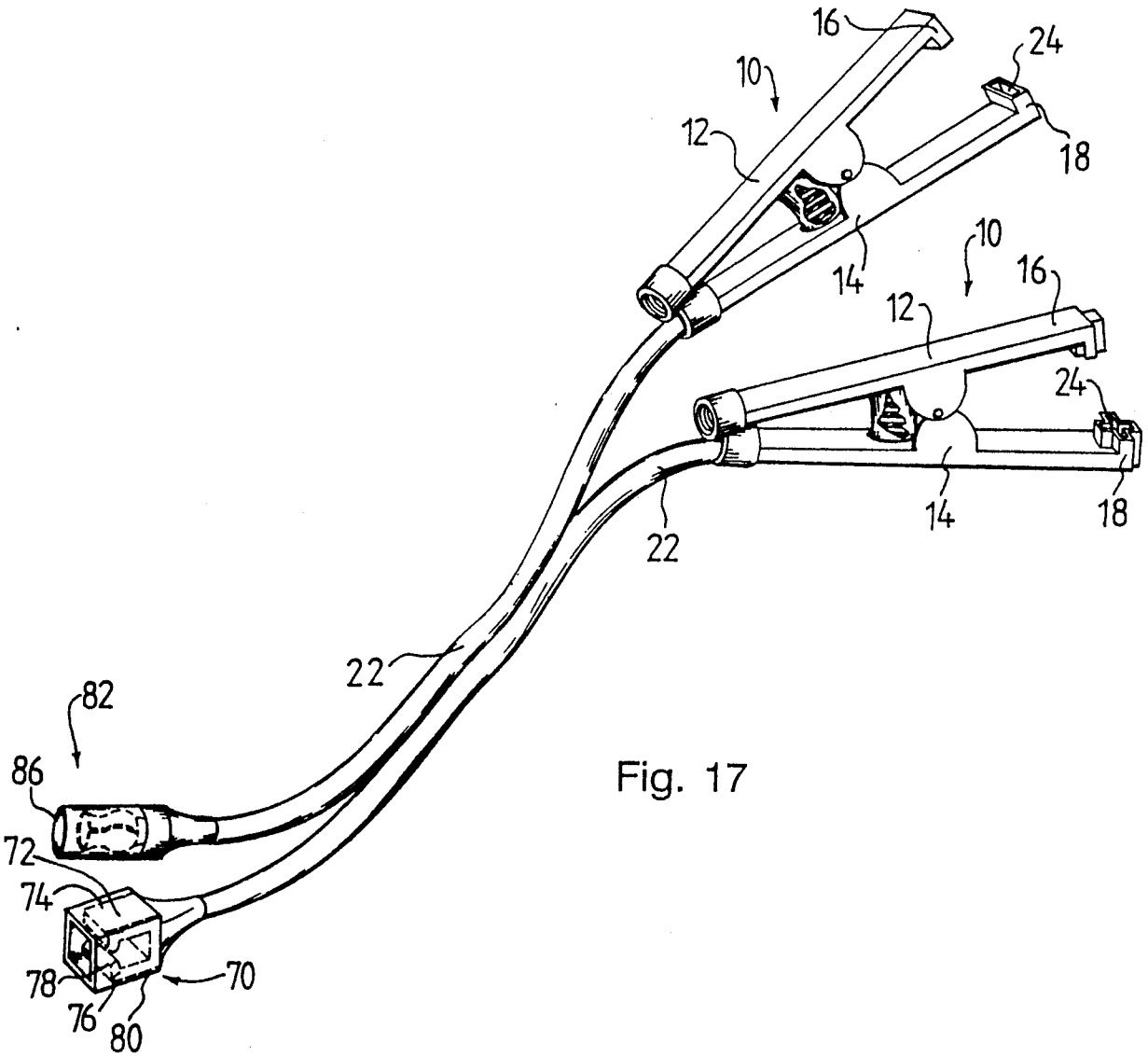
FIG. 17 illustrates yet a further embodiment of the jumper cable assembly of the present invention.

FIG. 17 illustrates yet another embodiment of booster cable assembly according to the present invention. Similar numerals are used to represent similar components from previous embodiments.

According to this embodiment, the booster clamp assembly 10 includes a combination of the elements from previous embodiments in which the handle assemblies illustrated in FIGS. 4A and 4B are used in conjunction with the socket arrangements from FIGS. 13B and 13A respectively. In this arrangement, the battery terminal mountings used on the batteries (not shown) will be those illustrated in FIG. 5A, for connection with the negative clamping member as illustrated and FIG. 5B for the positive clamping member. Similarly, socket 70 will engage mounting 90 of FIG. 14A and socket 82 engage mounting 90 in FIG. 14B.

In this arrangement, improper polarity connection between polarized terminals of the host and receiving batteries is not possible since cooperative locking engagement is only possible with a mating component.

It will be readily appreciated to those skilled in the art that a further negative mounting may be provided to connect the same to a bracket in the engine rather than terminal to terminal connection. In this way, the battery boosting procedure may be followed in accordance with vehicle manufacturers' instructions to avoid injury to the users of the booster cable assemblies disclosed herein.

It will be readily apparent to those skilled in the art that other combinations employing the embodiments discussed herein or elements thereof, apart from those described, are possible for different jumper cable assembly arrangements.

Although embodiments of the invention have been described above, it is not limited thereto and it will be apparent to those skilled in the art that numerous modifications form part of the present invention insofar as they do not depart from the spirit, nature and scope of claimed and described invention.

I claim:

1. A battery and jumper cable system for polarized connection between separate batteries comprising:

a pair of batteries each having a negative and positive terminal associated therewith;

each positive terminal of each battery having a first cooperative engaging member adapted to cooperatively engage a corresponding positive cooperative engaging member of a jumper cable;

each negative terminal of each battery having a second cooperative engaging member adapted to cooperatively engage a corresponding negative cooperative engaging member of a jumper cable;

a jumper cable having first and second jumper cable assemblies having opposed ends, each opposed end having a pair of conductive battery terminal clamping members each adapted to engage only a preselected negative or positive battery terminal;

one clamping member of each end having a first cooperating engaging means for engaging a positive battery terminal;

the other clamping member of each end having a second cooperating engaging means for engaging a negative battery terminal;

the first and second cooperating engaging means of each pair of clamping members at each end of said jumper cable being non-engageable with one another and non-engageable with a battery terminal of an opposite polarity with which the engaging member is adapted to engage.

2. The system as defined in claim 1, wherein the first and second engaging members each include recessed portions, the recessed portions of the first engaging portions being non-cooperative with the recessed portions of the second engaging members.

3. The system as defined in claim 1, wherein the first and second cooperating engaging means of said clamping members each include a projecting portion, said projecting portion of said first cooperating means being non-cooperative with the projecting portion of the second cooperating means.

4. The system as defined in claim 1, wherein the first and second engaging members each include projecting portions, the projecting portions of the first engaging portion being non-cooperative with the projecting portion of the second engaging member.

5. The system as defined in claim 1, wherein the first and second cooperating engaging means of said clamping members each include a recessed portion, said recessed portion of said first cooperating means being non-cooperative with the recessed portion of the second cooperating means.

6. The system as defined in claim 1, wherein the first and second cooperating means of said clamping members each include a conductive body having means for connection with said terminal.

7. A jumper cable for polarized connection between separate batteries comprising:

first and second jumper cable assemblies having opposed ends, each opposed end having a pair of conductive battery terminal clamping members each adapted to engage only a pre-selected negative or positive battery terminal;

one clamping member of each end having a first cooperating engaging means for engaging a positive battery terminal;

the other clamping member of each end having a second cooperating engaging means for engaging a negative battery terminal;

the first and second cooperating engaging means of each pair of clamping members at each end of said jumper cable being non-engageable with one another and non-engageable with a battery terminal of an opposite polarity with which the engaging member is adapted to engage.

8. The cable as defined in claim 7, wherein said first and second cooperating engaging means comprises a recess, said first cooperating engaging means being non-cooperative with said second cooperating means.

9. The cable as defined in claim 7, wherein said jumper cable assemblies each include handle members, said handle members being non-conductive.

10. The cable as defined in claim 7, wherein said one clamping member comprises a socket member.

11. The cable as defined in claim 7, wherein one end of said opposed ends of said cable includes said socket member.

12. The cable as defined in claim 7, wherein said first and second cooperating engaging means co a projection, said first cooperating engaging means being non-cooperative with said second cooperating means.

13. The cable as defined in claim 12, wherein said first and second cooperating engaging means are in electrical communication with said cable.

14. The cable as defined in claim 7, wherein said other clamping member comprises a socket member.

15. The cable as defined in claim 14, wherein both ends of said opposed ends of said cable assemblies include said socket member.

16. A battery and jumper cable system for polarized connection between separate batteries comprising:

a pair of batteries each having a negative and positive terminal associated therewith;

each positive terminal of each battery having a first cooperative engaging member adapted to cooperatively engage a corresponding positive cooperative engaging member of a jumper cable;

each negative terminal of each battery having a second cooperative engaging member adapted to cooperatively engage a corresponding negative cooperative engaging member of a jumper cable;

a jumper cable having first and second jumper cable assemblies having opposed ends, each opposed end having a pair of conductive battery terminal clamping members each adapted to engage only a preselected negative or positive battery terminal;

one clamping member of each end having a first cooperating engaging means for engaging a positive battery terminal;

the other clamping member of each end having a second cooperating engaging means for engaging a negative battery terminal;

the first and second cooperating engaging means of each pair of clamping members at each end of said jumper cable being non-engageable with one another and non-engageable with a battery terminal of an opposite polarity with which the engaging member is adapted to engage; and each including a conductive body having means for connection with said terminal and housed in a non-conductive housing, said housing facilitating electrical contact with said terminal.

* * * * *